US008882374B2

(12) United States Patent
Colonel et al.

(10) Patent No.: US 8,882,374 B2
(45) Date of Patent: Nov. 11, 2014

(54) PRINTER WITH PRINT FRAME INTERLOCK AND ADJUSTABLE MEDIA SUPPORT

(75) Inventors: Kenneth Colonel, Oviedo, FL (US); Raul Palacios, Apopka, FL (US); Ching-Yang Chou, New Taipei (TW); Dick Feng Yi Tai, New Taipei (TW)

(73) Assignee: Datamax—O'Neil Corporation, Orlando, FL (US)

( * ) Notice: Subject to any disclaimer, the term of this patent is extended or adjusted under 35 U.S.C. 154(b) by 158 days.

(21) Appl. No.: 13/481,067

(22) Filed: May 25, 2012

(65) Prior Publication Data

US 2013/0314721 A1 Nov. 28, 2013

(51) Int. Cl.
*B41J 15/02* (2006.01)
*B41J 15/04* (2006.01)
*B65H 16/06* (2006.01)

(52) U.S. Cl.
USPC ..... 400/613; 400/613.2; 400/693; 242/596; 242/596.7; 242/596.8

(58) Field of Classification Search
CPC ..... B65H 2301/41306; B65H 2301/41308; B65H 2301/41346; B65H 2301/413246; B65H 2301/4133; B65H 2301/41335; B65H 16/06; B65H 2301/41352; B65H 2301/41362; B41J 15/04; B41J 29/13
USPC ..... 242/591, 599.3, 595.1, 578.2, 596.1, 242/596.7, 596.8; 400/613.2, 613, 693
See application file for complete search history.

(56) References Cited

U.S. PATENT DOCUMENTS 3,999,110 A 12/1976 Ramstrom et al.
4,019,935 A 4/1977 Harvey
4,547,780 A 10/1985 Cummins
4,642,656 A 2/1987 Shibuya et al.
4,732,502 A 3/1988 Yokoi
4,738,176 A 4/1988 Cassia
4,776,714 A 10/1988 Sugiura et al.
4,795,281 A 1/1989 Ulinski, Sr. et al.

(Continued)

FOREIGN PATENT DOCUMENTS

EP 1 872 958 1/2008
JP 55101484 A 8/1980

(Continued)

OTHER PUBLICATIONS

International Search Report dated Dec. 2, 2010 regarding PCT/US10/52653.

(Continued)

*Primary Examiner* — Daniel J Colilla
(74) *Attorney, Agent, or Firm* — Carter, DeLuca, Farrell & Schmidt, LLP

(57) ABSTRACT

A printer having improved operational features. The printer includes an articulating print frame assembly coupled to a top cover that is adapted to rotate out of the top cover to an open position and to rotate into the top cover to a closed position. When the print frame is in an open position, the top cover is prevented from rotating toward the bottom housing to a closed position. The printer may include at least one media support member with a media adjustment channel disposed therein, a media adjustment member slidingly disposed through each of the media adjustment channels, and a resilient member configured to apply friction between each of the media adjustment members and the corresponding media support member.

18 Claims, 16 Drawing Sheets

(56) References Cited

U.S. PATENT DOCUMENTS

| | | | | |
|---|---|---|---|---|
| 4,797,690 | A | | 1/1989 | Takita et al. |
| 4,812,063 | A | | 3/1989 | Kunimitsu et al. |
| 4,895,466 | A | | 1/1990 | Hartman et al. |
| 4,909,648 | A | | 3/1990 | Hartman et al. |
| 5,037,218 | A | | 8/1991 | Shimizu et al. |
| 5,067,832 | A | | 11/1991 | Baur et al. |
| 5,085,532 | A | | 2/1992 | Surya et al. |
| 5,087,137 | A | | 2/1992 | Burnard et al. |
| 5,103,259 | A | | 4/1992 | Saitoh et al. |
| 5,143,461 | A | | 9/1992 | Inoue et al. |
| 5,195,837 | A | | 3/1993 | Steppe et al. |
| 5,198,836 | A | | 3/1993 | Saito et al. |
| 5,284,396 | A | | 2/1994 | Masumura et al. |
| 5,318,368 | A | | 6/1994 | Fogle et al. |
| 5,320,437 | A | | 6/1994 | Malke et al. |
| 5,322,377 | A | | 6/1994 | Asai |
| 5,326,182 | A | | 7/1994 | Hagstrom |
| 5,340,098 | A | | 8/1994 | Gunderson |
| 5,344,248 | A | | 9/1994 | Schoon et al. |
| 5,354,139 | A | | 10/1994 | Barrus et al. |
| 5,370,470 | A | | 12/1994 | Kim |
| 5,378,072 | A | | 1/1995 | Gunderson |
| 5,381,295 | A | | 1/1995 | Rund et al. |
| 5,399,036 | A | | 3/1995 | Yamaguchi |
| 5,438,349 | A | | 8/1995 | Fox et al. |
| 5,442,449 | A | | 8/1995 | Stemmle et al. |
| 5,470,242 | A | | 11/1995 | Cheng et al. |
| 5,478,159 | A | | 12/1995 | Schneider et al. |
| 5,480,242 | A | | 1/1996 | Gunderson |
| 5,483,624 | A | | 1/1996 | Christopher et al. |
| 5,496,121 | A | | 3/1996 | Gunderson |
| 5,501,537 | A | | 3/1996 | Kohno |
| 5,507,583 | A | | 4/1996 | Beaty et al. |
| 5,534,890 | A | | 7/1996 | Krug et al. |
| 5,563,686 | A | | 10/1996 | Beaufort et al. |
| 5,564,845 | A | | 10/1996 | Yamaguchi et al. |
| 5,570,962 | A | | 11/1996 | Suzuki et al. |
| 5,587,728 | A | | 12/1996 | Edgar |
| 5,588,761 | A | | 12/1996 | Seib |
| 5,594,838 | A | | 1/1997 | Christopher et al. |
| 5,613,790 | A | | 3/1997 | Miazga |
| 5,619,240 | A | | 4/1997 | Pong et al. |
| 5,619,244 | A | | 4/1997 | Manna |
| 5,622,440 | A | | 4/1997 | Yamamoto et al. |
| 5,630,511 | A | * | 5/1997 | Bose ..... 206/555 |
| 5,650,730 | A | | 7/1997 | Herbst, Jr. |
| 5,657,066 | A | | 8/1997 | Adams et al. |
| 5,672,020 | A | | 9/1997 | Leonard et al. |
| 5,707,162 | A | | 1/1998 | Kasai et al. |
| 5,788,384 | A | | 8/1998 | Goodwin et al. |
| 5,790,162 | A | | 8/1998 | Adams et al. |
| 5,802,973 | A | | 9/1998 | Mueller et al. |
| 5,805,779 | A | | 9/1998 | Christopher et al. |
| 5,813,343 | A | | 9/1998 | Harb |
| 5,820,279 | A | | 10/1998 | Lodwig et al. |
| 5,833,377 | A | | 11/1998 | Keller et al. |
| 5,833,800 | A | | 11/1998 | Goodwin et al. |
| 5,836,704 | A | | 11/1998 | Lau et al. |
| 5,872,585 | A | | 2/1999 | Donato et al. |
| 5,874,980 | A | | 2/1999 | West |
| 5,909,233 | A | | 6/1999 | Hamman et al. |
| 5,927,875 | A | | 7/1999 | Lau et al. |
| 5,938,350 | A | | 8/1999 | Colonel |
| 5,961,228 | A | | 10/1999 | Ward et al. |
| 5,980,138 | A | | 11/1999 | Shiozaki et al. |
| 5,995,128 | A | | 11/1999 | Adams et al. |
| 6,020,906 | A | | 2/2000 | Adams et al. |
| 6,030,133 | A | | 2/2000 | Endo |
| 6,034,708 | A | | 3/2000 | Adams et al. |
| 6,057,870 | A | | 5/2000 | Monnier et al. |
| 6,068,418 | A | | 5/2000 | Fox |
| 6,074,031 | A | | 6/2000 | Kahle |
| 6,127,678 | A | | 10/2000 | Christensen et al. |
| 6,129,463 | A | | 10/2000 | Lau et al. |
| 6,130,699 | A | | 10/2000 | Christensen et al. |
| 6,145,769 | A | | 11/2000 | Shiraishi et al. |
| 6,155,732 | A | | 12/2000 | Plasschaert et al. |
| 6,158,342 | A | | 12/2000 | Moore |
| 6,163,538 | A | | 12/2000 | Brown et al. |
| 6,202,954 | B1 | | 3/2001 | Tobin et al. |
| 6,231,253 | B1 | | 5/2001 | Henderson et al. |
| 6,232,996 | B1 | | 5/2001 | Takahashi et al. |
| 6,260,834 | B1 | | 7/2001 | Colonel et al. |
| 6,302,604 | B1 | | 10/2001 | Bryant et al. |
| 6,386,775 | B1 | | 5/2002 | Hamisch, Jr. et al. |
| 6,396,070 | B1 | | 5/2002 | Christensen et al. |
| 6,412,991 | B1 | | 7/2002 | Klinefelter et al. |
| 6,425,548 | B2 | | 7/2002 | Christensen et al. |
| 6,431,492 | B1 | | 8/2002 | Chillscyzn |
| 6,533,476 | B2 | | 3/2003 | Hamisch, Jr. et al. |
| 6,609,844 | B1 | | 8/2003 | Petteruti et al. |
| 6,616,362 | B2 | | 9/2003 | Bouverie et al. |
| 6,712,112 | B2 | | 3/2004 | Goodwin et al. |
| 6,805,183 | B2 | | 10/2004 | Goodwin et al. |
| 6,846,121 | B2 | | 1/2005 | Bouverie et al. |
| 6,874,958 | B1 | | 4/2005 | Panebianco et al. |
| 6,962,451 | B2 | | 11/2005 | Narita et al. |
| 7,004,462 | B2 | | 2/2006 | Bryer |
| 7,033,097 | B2 | | 4/2006 | Petteruti et al. |
| 7,040,822 | B2 | | 5/2006 | Fries et al. |
| 7,042,478 | B2 | | 5/2006 | Bouverie et al. |
| 7,131,778 | B2 | | 11/2006 | Tobin et al. |
| 7,189,576 | B2 | | 3/2007 | Fukuoka et al. |
| 7,372,475 | B2 | | 5/2008 | Vazac et al. |
| 7,375,832 | B2 | | 5/2008 | Bouverie et al. |
| 7,387,456 | B2 | | 6/2008 | Huggins et al. |
| 7,502,042 | B2 | | 3/2009 | Hitz et al. |
| 7,537,404 | B2 | | 5/2009 | Bouverie et al. |
| 7,600,684 | B2 | | 10/2009 | Tobin et al. |
| 7,699,550 | B2 | | 4/2010 | Bouverie et al. |
| 2002/0012559 | A1 | | 1/2002 | Takahashi et al. |
| 2002/0048479 | A1 | | 4/2002 | Bryant et al. |
| 2003/0141655 | A1 | | 7/2003 | Bryer |
| 2003/0205863 | A1 | | 11/2003 | Yang |
| 2004/0145579 | A1 | * | 7/2004 | Lilenfeld ..... 345/179 |
| 2005/0109602 | A1 | | 5/2005 | Parkinson et al. |
| 2006/0180737 | A1 | | 8/2006 | Consiglio |
| 2007/0166092 | A1 | | 7/2007 | Liu et al. |
| 2008/0073826 | A1 | | 3/2008 | Lin et al. |
| 2011/0023258 | A1 | * | 2/2011 | Sheddy et al. ..... 15/323 |
| 2011/0058878 | A1 | * | 3/2011 | Maeda et al. ..... 400/242 |
| 2013/0127318 | A1 | * | 5/2013 | Chen et al. ..... 312/327 |

FOREIGN PATENT DOCUMENTS

| | | | | | |
|---|---|---|---|---|---|
| JP | 56037850 | A | | 4/1981 | |
| JP | 59156786 | | | 9/1984 | |
| JP | 60204559 | A | | 10/1985 | |
| JP | 61197267 | | | 9/1986 | |
| JP | 04008551 | A | | 1/1992 | |
| JP | 4-112063 | | | 4/1992 | |
| JP | 04-292972 | | | 10/1992 | |
| JP | 05096832 | A | * | 4/1993 | ..... B41J 29/48 |
| JP | 05147782 | A | | 6/1993 | |
| JP | 11105364 | A | | 4/1999 | |
| JP | 2001253601 | A | * | 9/2001 | ..... B65H 16/06 |
| JP | 2002166611 | A | * | 6/2002 | ..... B41J 11/58 |
| JP | 2003341886 | A | * | 12/2003 | ..... B65H 16/06 |

OTHER PUBLICATIONS

European Search Report Application No. 11 19 2639 dated Apr. 18, 2012 (4 pages).

* cited by examiner

PRINTER WITH PRINT FRAME INTERLOCK AND ADJUSTABLE MEDIA SUPPORT

BACKGROUND

The present disclosure relates to continuous feed printers, and more particularly, to a label or thermal printer having an articulating print frame assembly and an adjustable media support. The disclosed printer also includes a fixed or adjustable media sensor, and is configurable to accommodate an internal supply of web (roll) media or an external or internal supply of fanfold media.

Label or thermal desktop printers are often used in commercial settings, e.g., in warehouses, in industrial and manufacturing environments, by shipping services, in restaurants, in the vending and gaming industries, and in other establishments for ticket printing, asset tracking, and inventory control. Generally, the printers weigh only a few pounds and are small enough to be readily provisioned in a work environment without significant site preparation. Such a printer may be operatively associated with an internal or external power supply that converts line voltage to the operating voltage(s) required by the printer. The printer may additionally or alternatively include a power source, such as a disposable or rechargeable battery, and may additionally communicate with a host terminal or network connection via a wired or wireless interface, such as an RS-232, Ethernet, USB, WiFi, Bluetooth, or optical interface.

A printer may utilize sheet-fed media, or, more popularly, continuous-feed media, e.g., rolls of paper, labels, tags, and the like. The printers commonly employ direct thermal transfer techniques, whereby thermochromic media passes over a thermal print head which selectively heats areas of the media to create a visible image. Also popular are thermal transfer printers which employ a heat-sensitive ribbon to transfer images to media.

A continuous feed printer is particularly suitable for printing onto stock material which may include, but is not necessarily limited to, labels, receipts, item labels, shelf labels/tags, ticket stubs, stickers, hang tags, price stickers, and the like. Such media may be provided in a web or roll configuration, or alternatively may be provided in a fanfold configuration, whereby individual media units (e.g., sheets or tags) are joined at the corresponding edges thereof and stacked in a zigzag manner.

In the case of continuous roll media, the media may be wound around a generally tubular core which supports the roll media. The core may have a standard size, or arbitrarily-sized inner diameter. Roll media is available in a wide range of widths and a wide range of diameters.

The adjacent edges of contiguous fanfold media units may include scoring or perforations to facilitate stacking and/or separation of the individual media units. Fanfold media may also be provided in a wide variety of widths.

Label printers may incorporate a media supply of self-adhesive labels adhered to a coated substrate wound in a rolled configuration. Alternatively, a media supply may include a plain paper roll suitable for ink-based, toner-based, direct thermal-based, or thermal transfer-based printing. During use, media may be drawn against a printing head, which, in turn, causes images to be created on the media stock by, e.g., impact printing (dot matrix, belt printing), by localized heating of thermochromic media (direct thermal printing), by transferring temperature-sensitive ink from a ribbon to the print media (thermal transfer printing), inkjet printing, toner-based printing, or other suitable printing methods.

The printers may be designed for use with one type of printing media or one particular size of print media, e.g., 2-inch label stock or 3-inch label stock. Other printers may be configurable to accommodate different media types and sizes. Such printers may include a media centering mechanism which is designed to accommodate roll media of varying widths and/or core diameters. The media centering mechanism may include opposing support members configured to engage the media roll core. A media centering mechanism typically includes first and second support members that are generally biased towards each other to secure the media roll. Movement of the first and second support members may be synchronized by one or more gears or belts such that, when a support member is moved a distance from the centerline of the media roll, the other support member moves a corresponding distance in the opposing direction from the centerline of the media roll.

SUMMARY

The present disclosure is directed to a printer. The printer includes a housing having a bottom chassis, and a hinged top cover that is operatively associated with an articulating print frame assembly contained therein. The top cover is selectively movable between a closed position, suitable for printer operation, and an open position. The open position of the top cover is suitable for the loading of media, e.g., roll media or fanfold media, and for the configuration of the printer for the desired media, e.g., adjustment or installation of media guide elements as discussed in detail herein. The print frame assembly includes supports for a transfer ribbon supply roll and a transfer ribbon take-up roll, and is pivotable between a closed position, wherein the print frame is pivoted towards the top cover, and an open position wherein the print frame swings away from the top cover to provide access to the supply ribbon support and the take-up ribbon support. A print head is operatively positioned between the transfer ribbon supply roll and the transfer ribbon take-up roll. During use, transfer ribbon is supplied from the transfer ribbon supply roll, over a print head, and to the transfer ribbon take-up roll.

The disclosed printer includes a lockout link that cooperates with the top cover and print frame assembly that prevents the top cover from being moved from an open to a closed position when the print frame is in an open position.

The disclosed printer may also include at least one media support member which includes a media adjustment channel disposed in each of the media support members. A media adjustment member may be slidingly disposed through each of the media adjustment channels and a resilient member may be included to apply friction between the media adjustment member and the corresponding media support member. The resilient member may be a spring which is held in place by a retaining member, such as, without limitation, a screw. In a preferred embodiment, two media support members are included wherein the two media support members are reciprocally movable along a transverse axis of the printer and are configured to support media therebetween.

Additionally, or alternatively, a stop may be provided which may be selectively adjustable along a transverse axis of the printer and adapted to prevent transverse motion of the single or multiple media support members. The media adjustment members may also include a tab which is configured to engage with a corresponding tab receiving member of the media support member. Additionally, or alternatively, the media support member may also include a detent which is configured to receive the corresponding media adjustment member. Further, the media adjustment member may also include an engaging member and a shaft which is slidingly disposed in the media adjustment channel.

The print frame includes a transverse media guide bar pivotably mounted thereto. The media guide includes a biasing member, e.g., a torsion-spring, that biases the guide bar against the ribbon to take up slack and maintain tautness along the ribbon traversal. The guide bar include a smooth, arcuate surface over which the media passes and which facilitates unwavering deliver of media and transfer ribbon to the print head, which improves print quality and reduces the likelihood of malfunction, e.g., jams, irregular print, and the like.

The disclosed printer also includes a media sensor that may be provisioned in a fixed configuration or an adjustable configuration. The disclosed printer may be additionally or alternatively be configured to accommodate an internal supply of web (roll) media, or an external or internal supply of fanfold media.

In another aspect, a printer in accordance with the present disclosure includes a dual wall, frame housing that provides improved strength and shock resistance. The dual wall construction includes a continuous inner frame structure adapted to support one or more internal printer components, which may include, without limitation, a printhead, a roller assembly, a drive assembly, media centering assembly, and/or a battery assembly. The inner frame is surrounded at least in part by a second, outer structure that provides additional stiffness, strength, and drop resistance. The housing includes a media access opening and a corresponding media access cover configured to facilitate the loading of media into the printer. The size of the media access opening is kept to the minimum size necessary to accommodate the media for use with the printer. By minimizing the media opening, greater space is available for the inner frame and/or the outer structure, further improving the strength, rigidity, and impact resistance of the printer.

The disclosed printer may include one or more connectors that extend from the interior of housing to the exterior. While the connector(s) may include an electrical connector, other connector types are contemplated within the scope of the present disclosure, e.g., moisture-proof connectors, fluidic connectors, security connectors (e.g., K-Slot), and the like. In embodiments, two electrical connectors are provided, wherein a first connector is adapted to couple a source of electrical power to the printer and a second connector is adapted to couple a data signal to the printer. In embodiments, the disclosed printer may include a USB connector, a serial (e.g., RS-232, RS-422, RS-485), connector, a Firewire (IEEE-1394) connector, a network (10 Base-T, 100 Base-T, and 1000 Base-T) connector, and/or a parallel (IEEE 1284) connector.

Also disclosed is print frame lockout mechanism. The mechanism includes an upper chassis that is pivotable about a hinge between a closed position and an open position. An arcuate friction member is disposed about the hinge and includes a notch defined therein. A print frame is pivotably coupled to the upper chassis and is movable between a closed position and an open position. The mechanism further includes a lockout link having a first end operably coupled to the print frame, and a second end having a pawl. When the print frame is in an open position, the pawl engages the notch, which, in turn, prevents the upper chassis and/or cover from pivoting. The arcuate friction member may include one or more detents configured to support the upper chassis in a fixed position. The disclosed mechanism may additionally or alternatively include a first pin extending from the print frame assembly that is configured to engage a corresponding opening defined in an upper portion of the lockout link, a second pin extending from the upper chassis, and a slot defined in the lockout link that slidably engages the second pin.

In some embodiments, a printer in accordance with the present disclosure includes a bottom housing having a top cover coupled thereto. The top cover is adapted to rotate away from the bottom housing to an open position and rotate toward the bottom housing to a closed position. The printer includes a print frame assembly coupled to the top cover that is adapted to rotate out of the top cover to an open position and to rotate into the top cover to a closed position. When the print frame is in an open position, the top cover is prevented from rotating toward the bottom housing to a closed position. The disclosed printer may include a means for retaining the print frame assembly in a closed position, such as without limitation, a latch. The print frame includes a print head for transferring indicia onto the print media.

A media sensor may be disposed along the path of the print media (e.g., the feed patch) and in an embodiment may be adjustable along an axis transverse to the print path. In embodiments, the print frame assembly may include a media guide pivotably mounted thereto by at least one side arm. The media guide includes a biasing member, such as without limitation, a torsion-spring, that is configured to bias the media guide outward from the print frame assembly. The media guide may include an arcuate media-contacting surface. In embodiments, the printer includes first and second media support members that are reciprocally movable along a transverse axis of the printer and configured to support roll media held therebetween. An adjustable stop selectively adjustable along a transverse axis of the printer and adapted to prevent transverse motion of a media support member may additionally be included. In embodiments, the support member may configured to operably engage a fanfold guide. An elongate opening in an outer surface of the printer may be provided to facilitate the feeding of external media into the fanfold guide. Additionally or alternatively, fanfold media may be disposed internally and in between media support members.

BRIEF DESCRIPTION OF THE DRAWINGS

Various embodiments of the subject instrument are described herein with reference to the drawings wherein.

DETAILED DESCRIPTION

Figure 1:
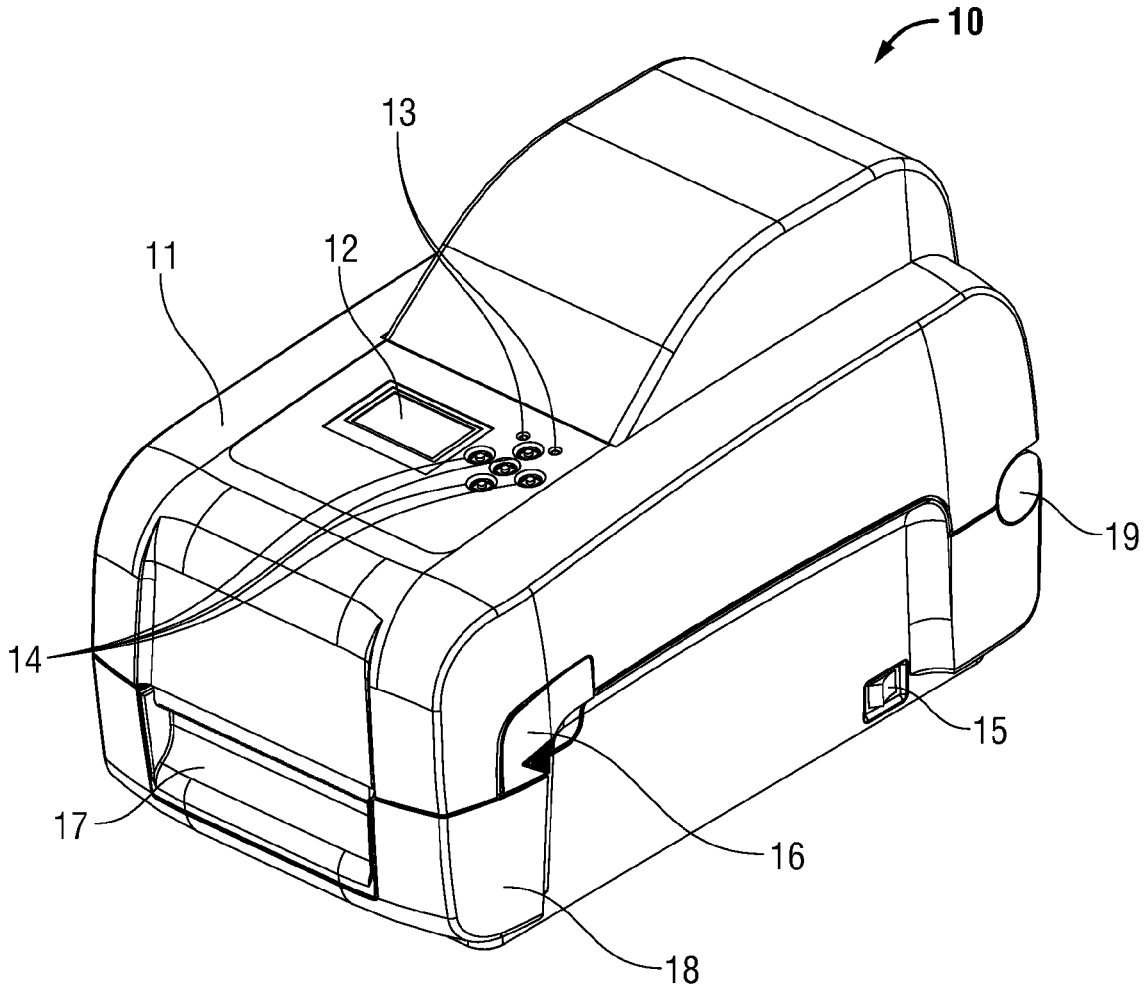
FIG. 1 is a view of an example embodiment of a printer in accordance with the present disclosure having a top cover in a closed position.

Particular embodiments of the present disclosure are described hereinbelow with reference to the accompanying drawings; however, it is to be understood that the disclosed embodiments are merely examples of the disclosure, which may be embodied in various forms. Well-known and/or repetitive functions and constructions are not described in detail to avoid obscuring the present disclosure in unnecessary or redundant detail. Therefore, specific structural and functional details disclosed herein are not to be interpreted as limiting, but merely as a basis for the claims and as a representative basis for teaching one skilled in the art to variously employ the present disclosure in virtually any appropriately detailed structure. In addition, as used herein, terms referencing orientation, e.g., "top", "bottom", "up", "down", "left", "right", "clockwise", "counterclockwise", and the like, are used for illustrative purposes with reference to the figures and features shown therein. It is to be understood that embodiments in accordance with the present disclosure may be practiced in any orientation without limitation. In this description, as well as in the drawings, like-referenced numbers represent elements which may perform the same, similar, or equivalent functions.

Figure 2:
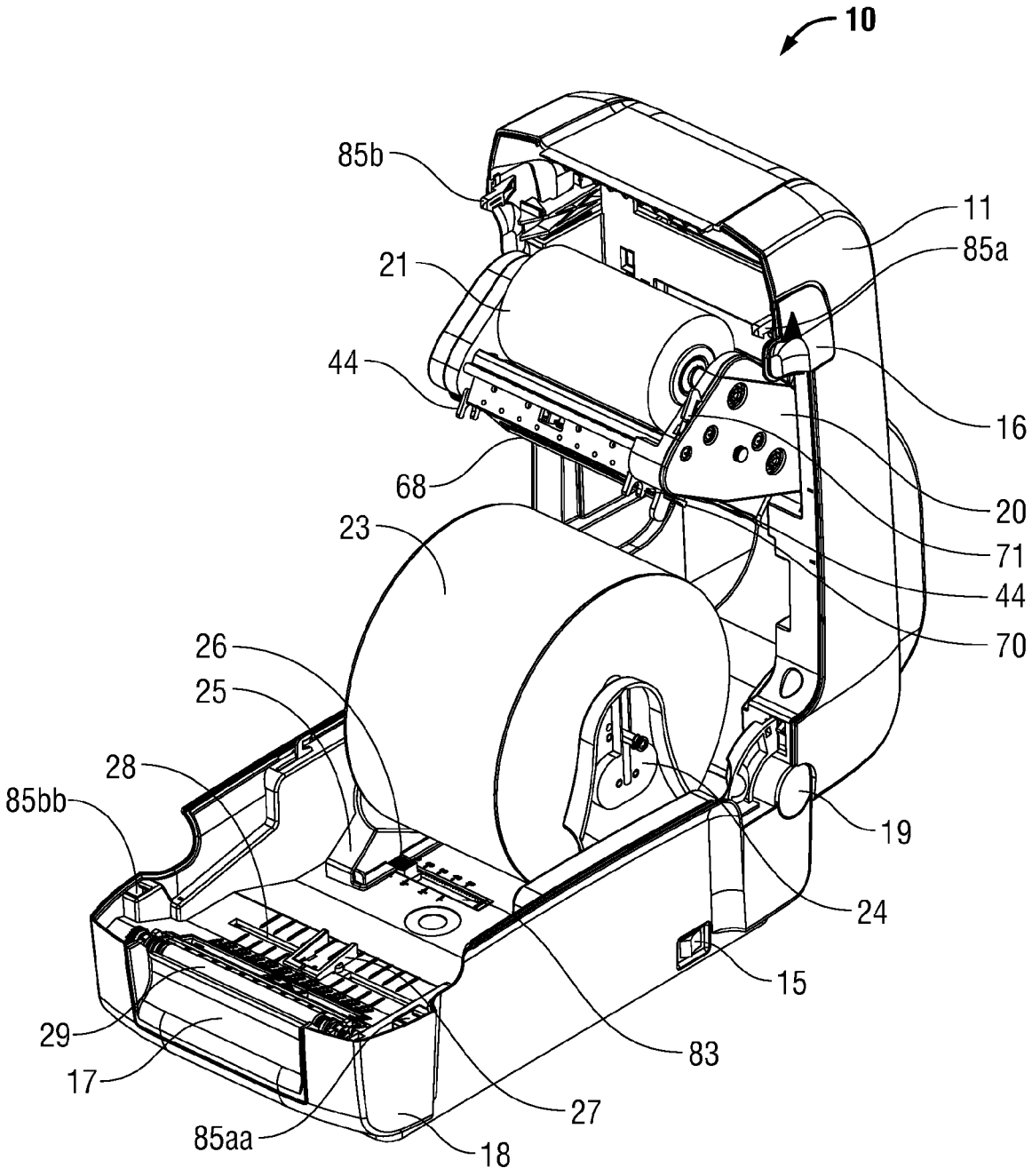
FIG. 2 is a view of the FIG. 1 embodiment of a printer in accordance with the present disclosure having a top cover in an open position and a print frame in an open position.

FIGS. 1 and 2 present an example embodiment of a printer 10 in accordance with the present disclosure. The printer 10 includes a bottom housing 18 and a selectively positionable top cover 11 that may be positioned in a closed position as shown in FIG. 1 and an open position as shown in FIG. 2. Top cover 11 and bottom housing 18 are pivotably joined by a hinge 19. Top cover 11 includes a user interface panel 12, one or more user input devices 14, and one or more indicators 13. User interface panel 12 many be any suitable form of display panel, including without limitation an LCD screen. User input device 14 may be any suitable form of input device, e.g., a snap dome or membrane pushbutton switch. Indicator 13 may be any suitable indication, such as without limitation a light-emitting diode (LED). Indicator 13 may illuminate to indicate the status an operational parameter, e.g., power, ready, media empty, media jam, self test, and the like. Printer 10 includes a power switch 15. A pair of latches 16 are disposed on either side of top cover 11 to retain top cover 11 in a closed position, and may be disengaged using finger pressure to facilitate opening of top cover 11. A media door 17 provides an alternative point of egress for media, which may be advantageous with self adhesive labels whereby the labels peel away from the substrate upon exiting the printer.

Figure 3:
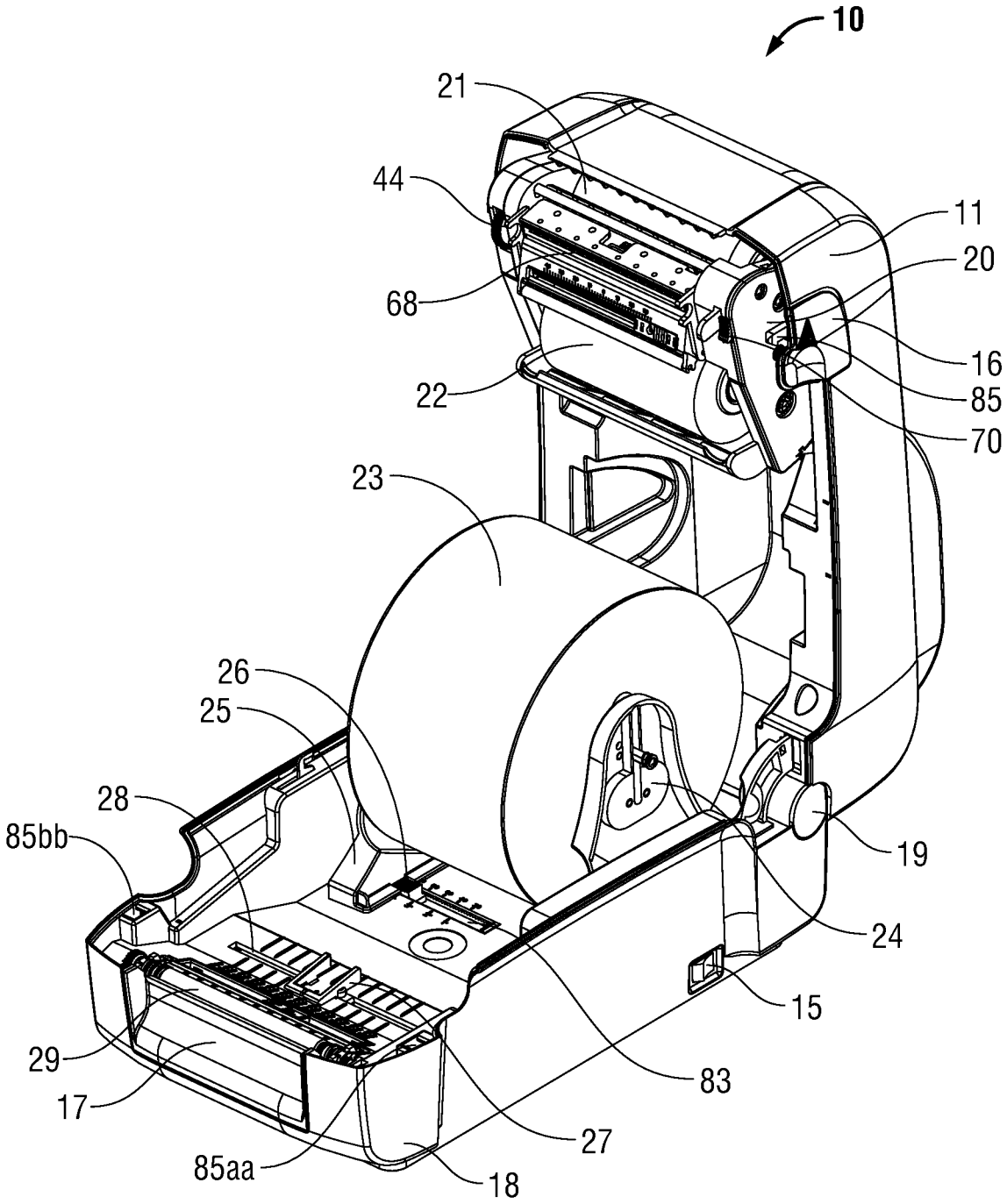
FIG. 3 is a view of the FIG. 1 embodiment of a printer in accordance with the present disclosure having a top cover in an open position and a print frame in a closed position.

With regard to FIGS. 2 and 3, top cover 11 includes a print frame assembly 20 pivotably mounted therein. Print frame assembly 20 includes a ribbon supply roll 22 (FIG. 3) and a ribbon take up roll 21 that are arranged to supply transfer ribbon (not explicitly shown) across a print head 68. Print frame assembly 20 is selectively positionable between an open position as shown in FIG. 2 and a closed position as shown in FIG. 3. As shown in FIG. 2, print frame assembly 20 includes a latch 71 that engages a retaining pin (not explicitly shown) provided within top housing 11 to retain print frame assembly 20 in a closed position. A release 70 is operatively associated with latch 71 such that, when depressed, release 70 releases latch 71 from the retaining pin to enable print frame assembly 20 to swing outward from the closed position to an open position.

Continuing with reference to FIGS. 2 and 3, printer 10 includes a first and a second media support member 24, 25, respectively, that are configured to support roll media 23 held therebetween. As will be further discussed below, first media guide member 27 and a second media guide member 28 are moveable along a transverse axis and are operatively associated with a second reciprocal movement mechanism (not explicitly shown) that is configured to translate a transverse movement of first media guide member 27 into a corresponding opposite transverse movement of second media support member 28, and vice versa. A platen roller 29 opposes print head 68 when top cover 11 is in the closed position to ensure intimate contact between print head 68, transfer ribbon (not explicitly shown), and media 23 during use, which, in turn, promotes consistent high print quality. Print head 68 includes a pair of fork-like saddles 44 that engage a portion of platen roller 29 to ensure precise alignment between print head 68 and platen roller 29 when top cover 11 is in a closed position. A tab 85 extends from print frame assembly 20 that is configured to engage a corresponding slot (not explicitly shown) provided in bottom housing 18 to enable the top cover 11 and/or the print frame 20 to close while ensuring the saddles 44 smoothly engage the platen roller 29 and/or a bushing (not explicitly shown) associated therewith.

Turning now to FIGS. 4-7, printer 10 includes a lockout link 30 that prevents closure of the top cover 11 when print frame assembly 20 is in an open position. An upper chassis 39 is provided within top cover 11. Upper chassis 39 includes slot 74. Print frame assembly 20 is pivotably joined to upper chassis 39 by a pair of pivots 72. Arcuate friction member 32 is disposed about hinge 19 and is configured to slide through slot 74 of upper chassis 39. Additionally or alternatively, a single detent 36 or a series of detents 36 on friction member 32 engages corresponding slot 74 in upper chassis 39, which facilitates the positioning of top cover 11 in a fully open position, a fully closed position, and several intermediate positions therebetween.

Figure 4:
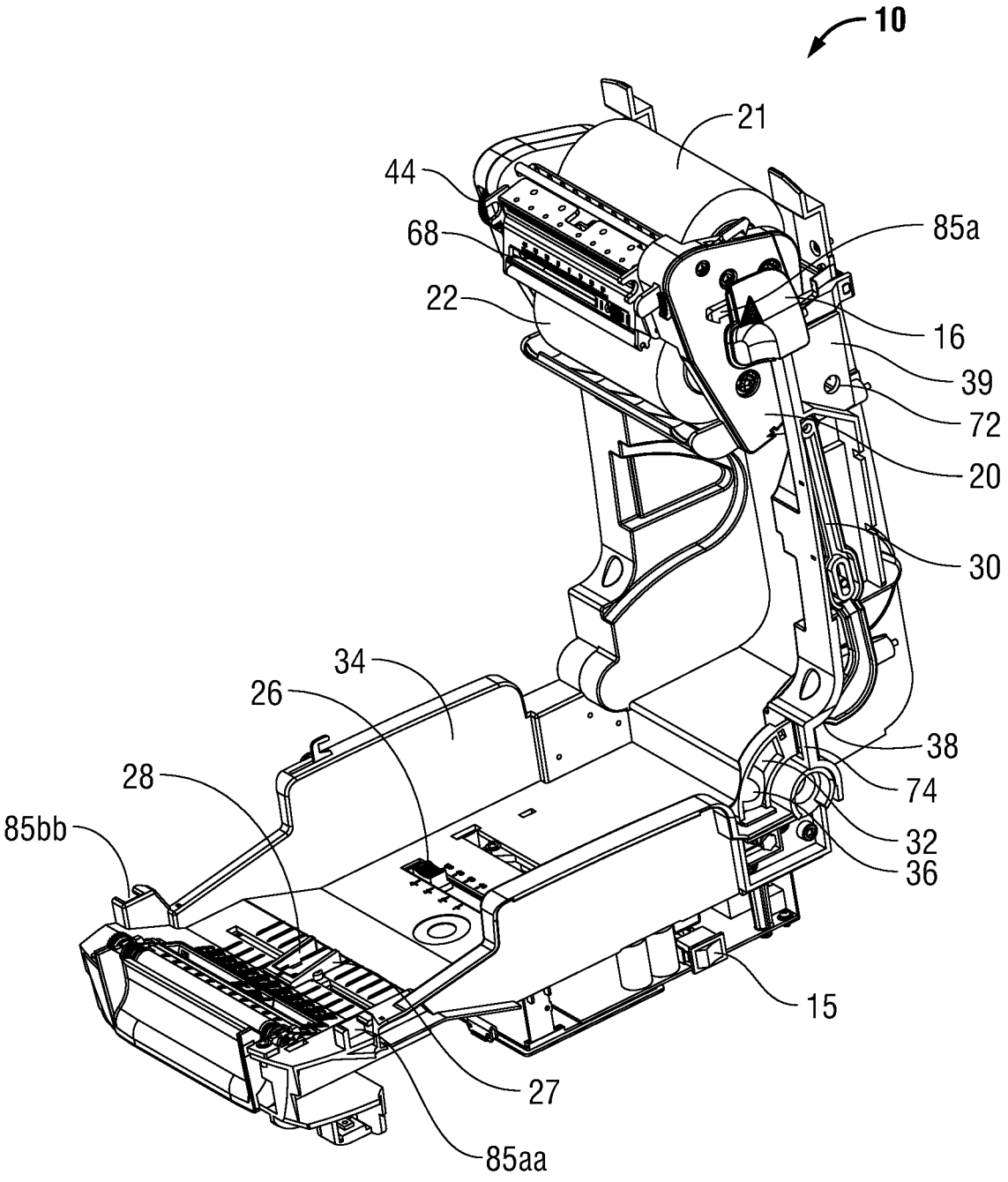
FIG. 4 is a view of a print frame module, lower chassis, and a lockout link of an example embodiment of a printer in accordance with the present disclosure.

As best seen in FIG. 4, when print frame assembly 20 is in a closed position, pawl 38 of lockout link 30 is not disposed or otherwise extended through slot 74 of upper chassis 39. In this position, upper chassis 39 and/or top cover 11 is not restricted from moving to a closed position, e.g. top cover 11 and/or upper chassis 39 can be pivoted counterclockwise. Specifically, with pawl 38 not disposed through slot 74 of upper chassis 39, friction member 32 is free to slide through slot 74 of upper chassis 39. A user may shift friction member 32 to the side using detent 36 to assist in sliding upper chassis 39 about friction member 32 through the slot 74.

Figure 5:
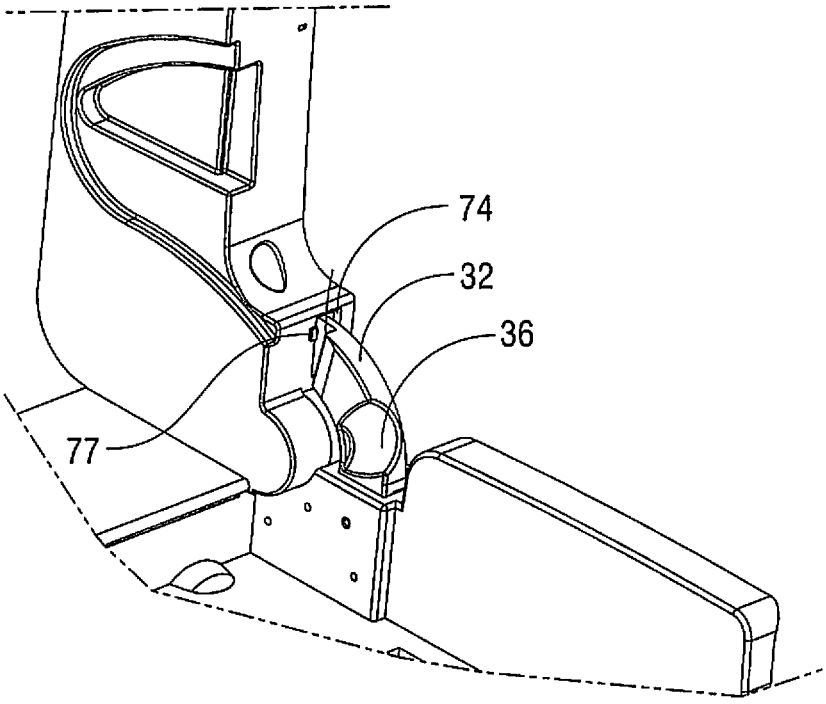
FIG. 5 is a view of a print frame module, lower chassis, and a lockout link of an example embodiment of a printer in accordance with the present disclosure.

Turning now to FIG. 5, a male protrusion 77 is shown disposed adjacent to slot 74 on upper chassis 39. Male protrusion 77 is configured to fit in a female pocket 78 of the friction member 32. When top cover 11 and/or upper chassis 39 is in the open position, male protrusion 77 rests within female pocket 78 of friction member 32 to prevent side movement of friction member 32. Thus, in order to close top cover 11 and/or upper chassis 39, a user must first disengage male protrusion 77 from female pocket 78. Upon disengaging male protrusion 77 from female pocket 78, friction member 32 is free to be moved to the side for passage through slot 74 of upper chassis 39.

Figure 6:
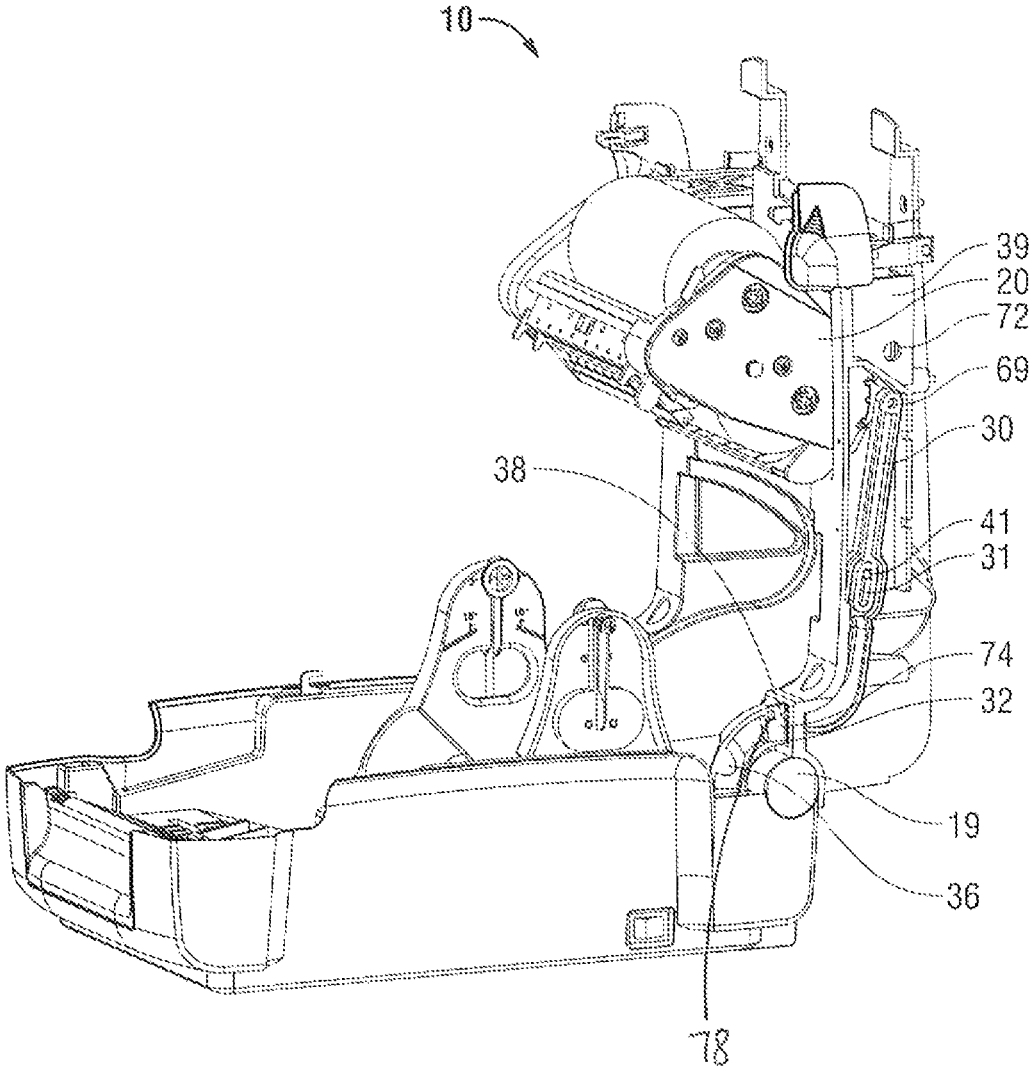
FIG. 6 is a view of the FIG. 2 embodiment with the top cover removed which illustrates a print frame module and lockout link in an open position in accordance with the present disclosure.
Figure 7:
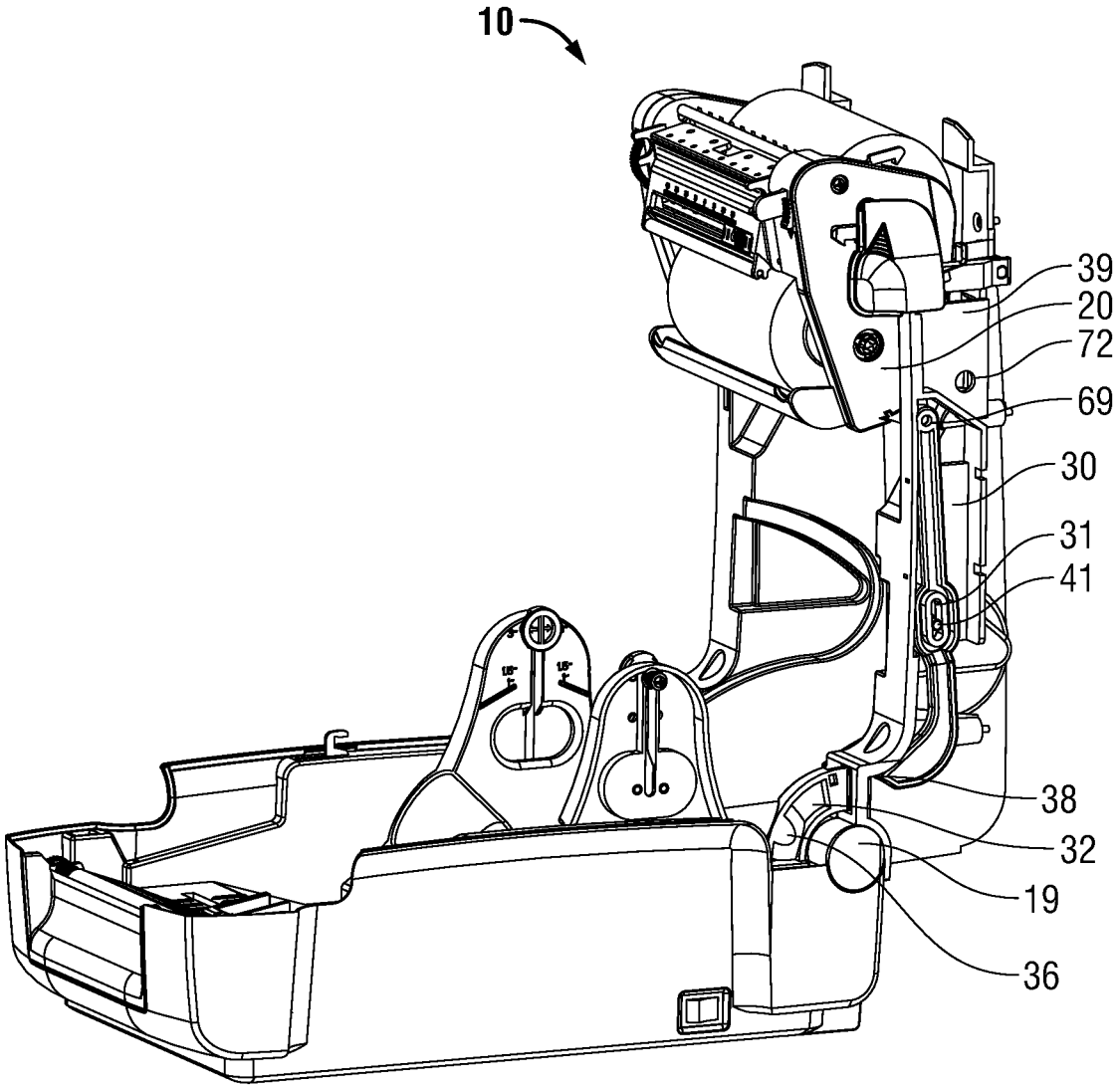
FIG. 7 is a view of the FIG. 3 embodiment with the top cover removed which illustrates a print frame module and lockout link in a closed position in accordance with the present disclosure.

As best seen in FIGS. 6 and 7, lockout link 30 is configured to prevent closure of the top cover 11 when print frame assembly 20 is in an open position (FIG. 6). Print frame assembly 20 includes a pin 69 operably coupled print frame assembly 20 to an upper portion of lockout link 30. Lockout link 30 includes slot 31 that slidably engages pin 41 of upper chassis 39 to facilitate the articulation of lockout link 30 when print frame 20 is moved between the open position (FIG. 6) and the closed position (FIG. 7). In the open position, print frame assembly 20 is pivoted forward on pivot 72, causing the lockout link 30 to ride upward and to rotate slightly clockwise on pin 41, which, in turn, causes pawl 38 of lockout link 30 to extend through slot 74 of upper chassis 39. In this position, i.e., when pawl 38 of lockout link 30 is disposed through slot 74 of upper chassis 39, top cover 11 and/or upper chassis 39 is prevented from moving to a closed position, e.g., top cover 11 and/or upper chassis 39 cannot be pivoted counterclockwise. Specifically, when pawl 38 is disposed through slot 74 of upper chassis 39, friction member 32 is restricted from passing through slot 74 of upper chassis 39.

As print frame 20 moves clockwise from an open position to a closed position, pin 69 moves upward and leftward about pivot 72, which, in turn, rotates lockout link 30 counterclockwise and draws lockout link 30 upward, thereby disengaging pawl 38 from slot 74 of upper chassis 39 and establishing sufficient clearance between the lower portion of lockout link 30 and friction member 32 to enable top cover 11 to be moved into a closed position.

Figure 8:
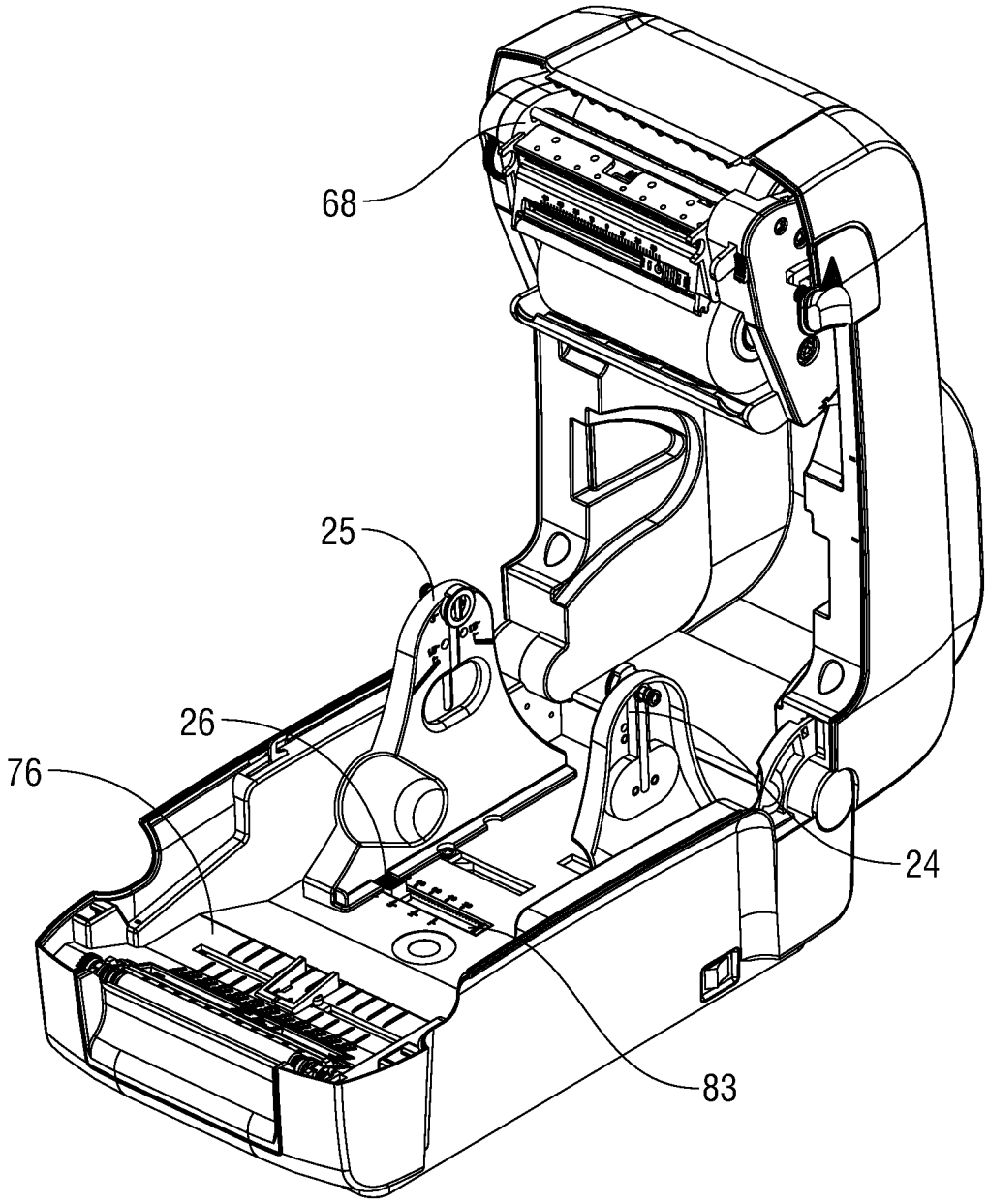
FIG. 8 is a view of an example embodiment of a printer with media support members in a first position in accordance with the present disclosure.
Figure 9:
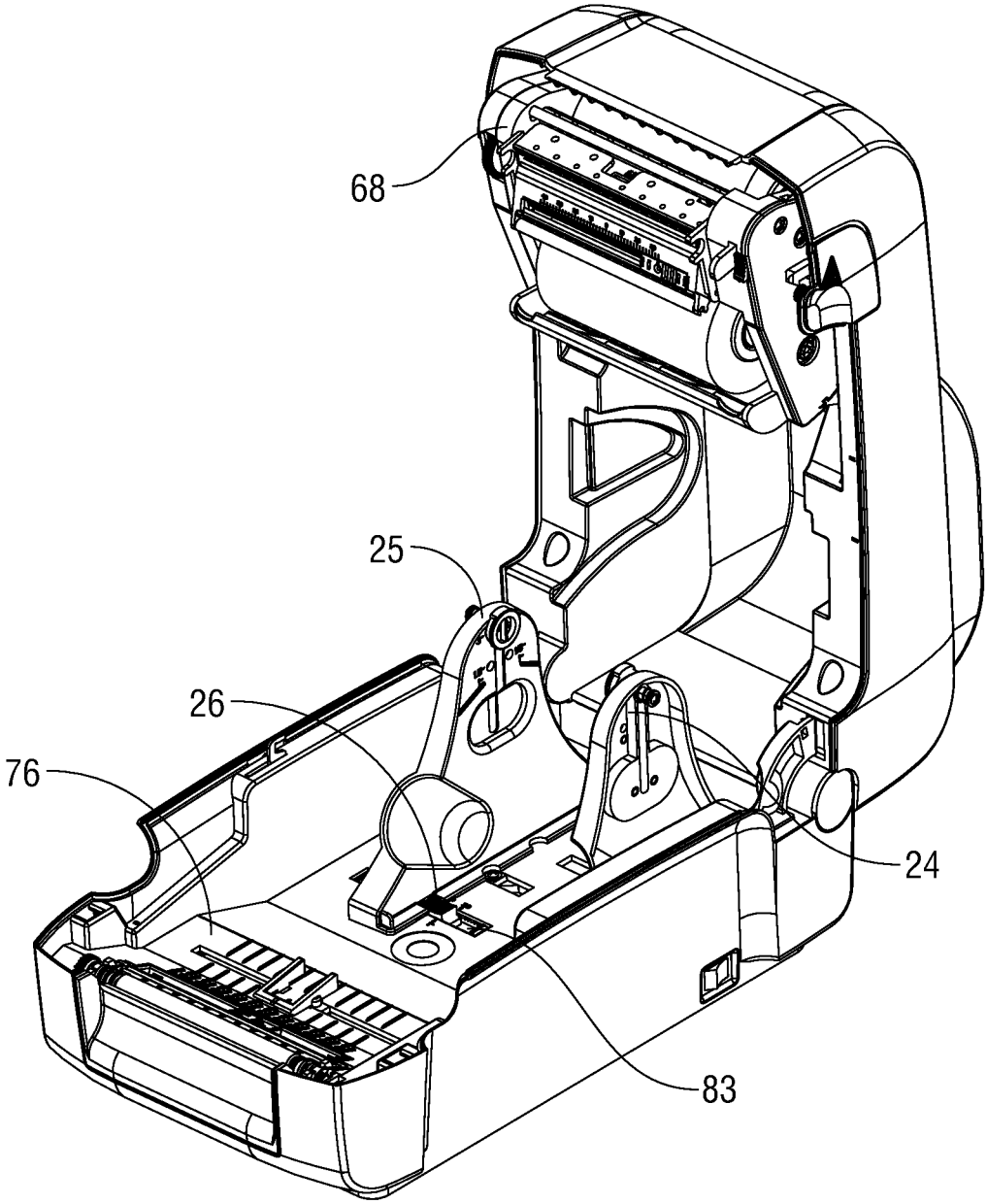
FIG. 9 is a view of an example of the printer of FIG. 8 with media support members in a second position in accordance with the present disclosure.

Turning now to FIGS. 8 and 9, media support members 24 and 25 are moveable along a transverse axis and are operatively associated with a reciprocal movement mechanism (not explicitly shown) that is configured to translate a transverse movement of first media support member 24 into a corresponding opposite transverse movement of second media support member 25, and vice versa, between a first position in which first media support member 24 and second media support member 25 are placed in a spaced relation that is further apart, and a second position in which first media support member 24 and second media support member 25 are in a spaced relation that is closer together. By this arrangement, roll media 23 (not shown) of arbitrary width may be accommodated while concurrently centering roll media 23 (not shown) with respect to the longitudinal axis "A-A" of the print head 68 and thus to the centerline of a feed path 76 corresponding thereto. First and a second media support members 24, 25 may be biased inwardly, e.g., toward the centerline, by a biasing member, e.g., a spring (not explicitly shown), to aid in gripping media roll 23 (not shown) between the support members 24, 25. A selectively adjustable stop 26 enables the position of media support members 24, 25 to be preset. Stop 26 is slidably disposed within an elongated slot 83 transversely defined in feed path 76 of lower chassis 34. Stop 26 and elongated slot 83 are configured to provide sufficient friction through mechanical detents and discrete positions therebetween to enable stop 26, when positioned, to overcome the inward biasing force of media support members 24, 25 and maintain media support members 24, 25 in the desired position.

Figure 10:
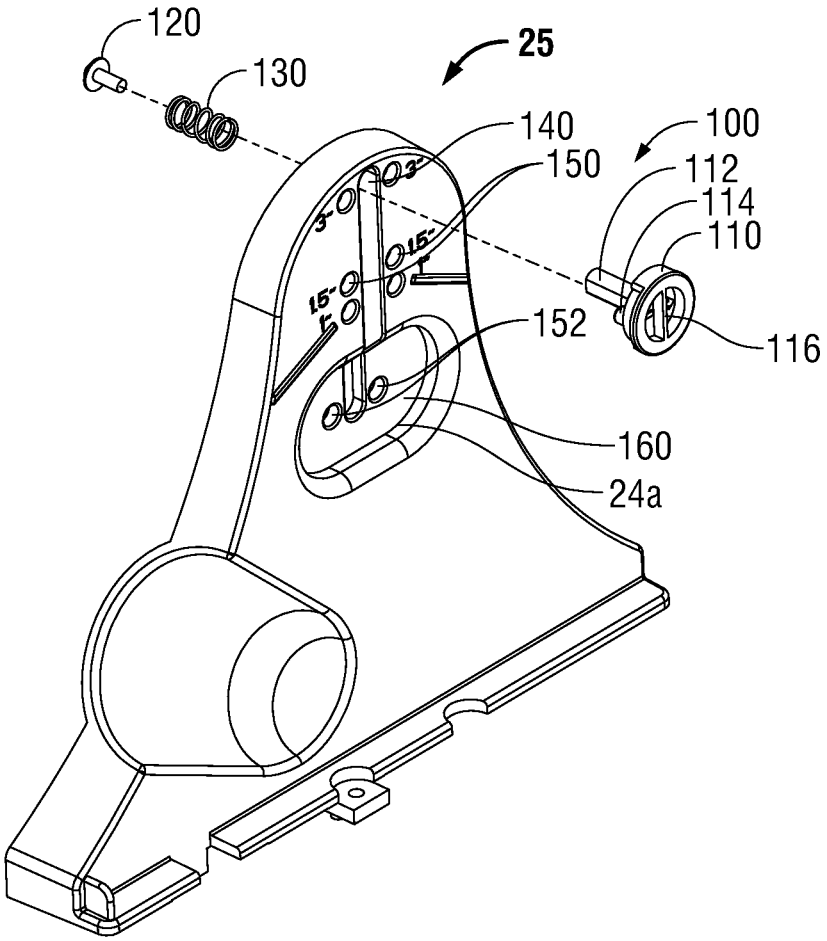
FIG. 10 is an exploded view of an embodiment of a media support member in accordance with the present disclosure.

Turning now to FIG. 10, both media support members 24 and 25 include media adjustment channel 140, tab receiving members 150, detent 160, and media adjustment assembly 100 which enables the compatibility of multiple forms of media, i.e., roll media and fanfold media, with printer 10. Media adjustment assembly 100 also enables compatibility of media of ranging diameters to be used with printer 10. Media adjustment assembly 100 includes media adjustment member 110 which is operatively engaged with retaining member 120. Resilient member 130 is disposed between media adjustment member 110 and retaining member 120.

Media adjustment member 110 may include a shaft 112, tabs 114, and a handle 116. Shaft 112 is slidably disposed within media adjustment channel 140. Tabs 114 are configured to match and fit into tab receiving members 150 to selectively position media adjustment member 110 in different positions (FIGS. 11A-11C) to enable use of different media types in printer which have different sizes in diameter. Additionally, media adjustment member 110 may be placed in detent 160 where tabs 114 would engaged with the bottom-most tab receiving members 152. When media adjustment member 100 is placed in the bottom-most position, i.e., tabs 114 are disposed in the bottom-most tab receiving members 152, media adjustment member 110 is disposed in detent 160 thus causing media adjustment member 110 to lay flush with the inner surface 24*a* of media support member 24 (or similarly to inner surface of media support member 25 which is not shown).

Figure 11A:
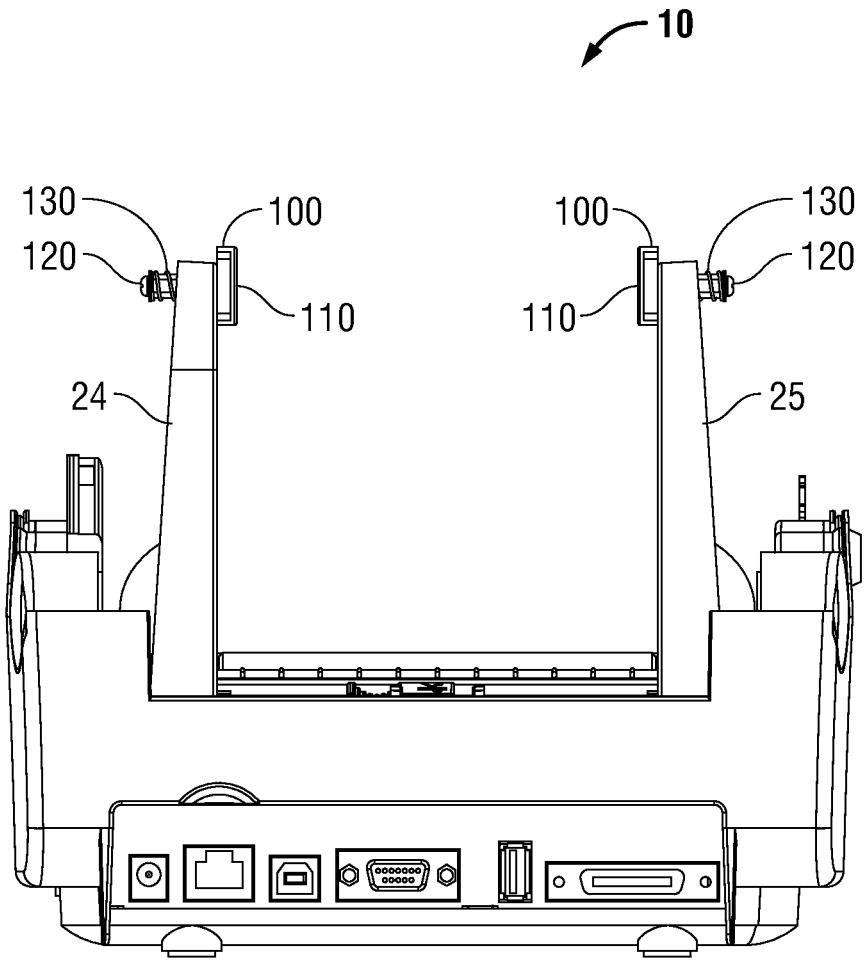
FIG. 11A is a rear view of an embodiment of a printer with a media adjustment assembly in a first position in accordance with the present disclosure.

Turning now to FIG. 11A, printer 10 is shown with media adjustment assembly 100 in the top-most position. In this position, printer 10 is capable of supporting a media roll with a large diameter. With media adjustment assembly 100 in the top-most position, tabs 114 of media adjustment members 110 are disposed in the top-most tab receiving members 150.

Figure 11B:
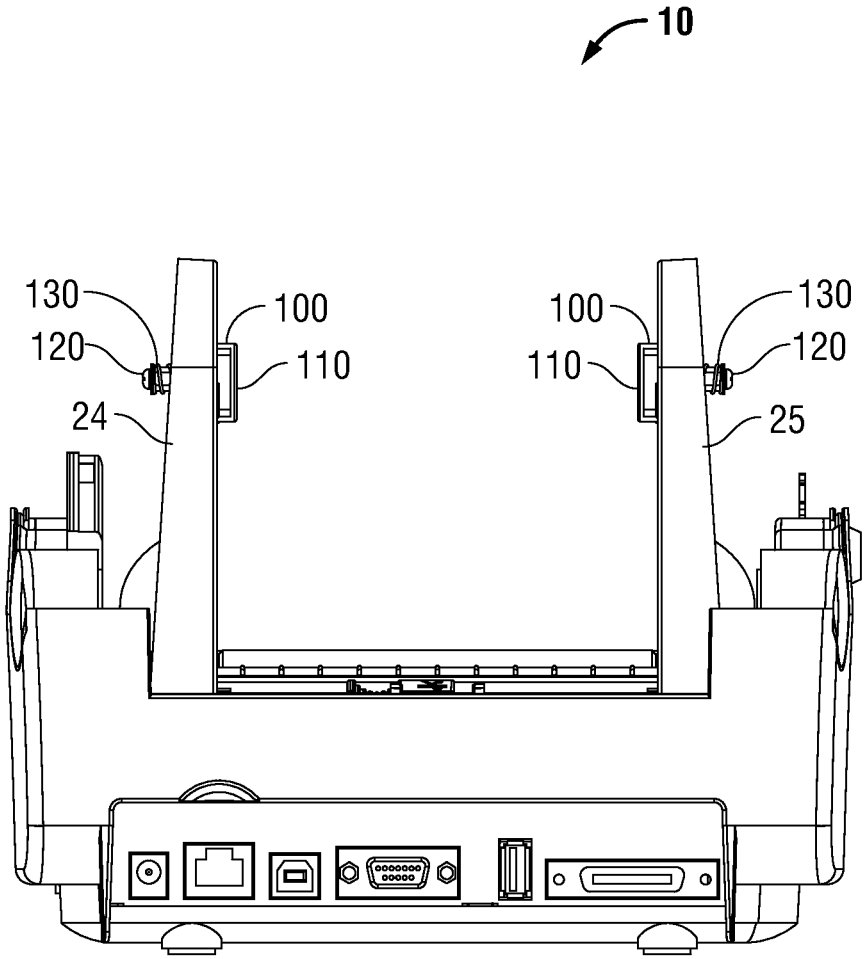
FIG. 11B is a rear view of an embodiment of a printer with a media adjustment assembly in a second position in accordance with the present disclosure.

Referring now to FIG. 11B, printer 10 is shown with media adjustment assembly 100 in a position for housing a roll media with a smaller diameter than that which would be used in FIG. 11A. In order to place media adjustment assembly 100 in this position, a user may grip handle 116 (FIG. 10) and pull media adjustment member 110 distally away from retaining member 120 causing a tension in resilient member 130 in order to disengage tabs 114 from tab receiving members 150. Upon removal of tabs 114 from tab receiving members 150, the user may slide media adjustment member 110 within media adjustment channel 140 to a desired pair of tab receiving members 150. Upon reaching the desired pair of tab receiving members 150, the user may release handle 116 which places tabs 114 into the corresponding tab receiving member 150 by the force of the resilient member 130.

Figure 11C:
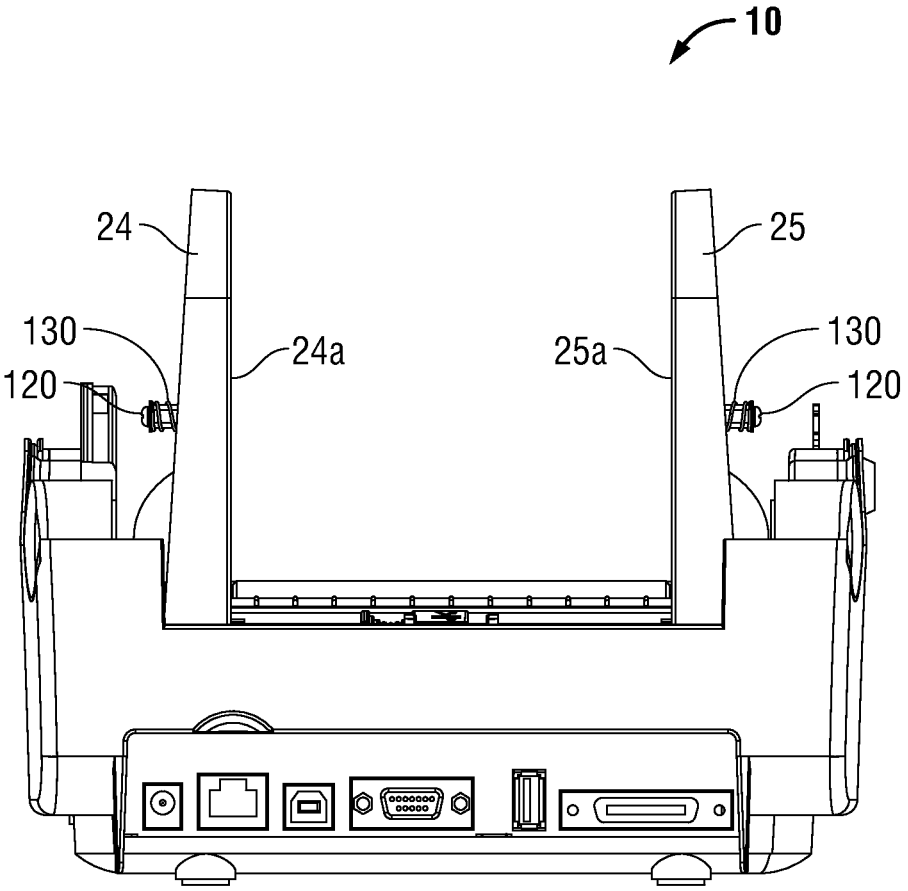
FIG. 11C is a rear view of an embodiment of a printer with a media adjustment assembly in a third position in accordance with the present disclosure.

Referring now to FIG. 11C, printer 10 is shown with media adjustment assembly 100 in a position for housing a media cartridge 400 (FIGS. 13 and 14), such as without limitation, a fan fold media. In order to place media adjustment assembly 100 in this position, a user may grip handle 116 (FIG. 10) and pull media adjustment member (not shown) distally away from retaining member 120 causing tension in resilient member 130 in order to disengage tabs 114 from tab receiving members 150. Upon removal of tabs 114 from tab receiving members 150, the user may then slide media adjustment member 110 downward within media adjustment channel 140 to the bottom-most position, such that tabs 114 engage the bottom-most tab receiving members 150. Upon positioning media adjustment member 110 to the bottom-most position, media adjustment members 110 are flush with inner surfaces 24*a* and 25*a* of media support members 24 and 25, respectively.

Handle 116 may serve the dual purpose of both enabling a user to adjust the media adjustment assembly 100 within the media adjustment channel 140 and retaining a roll media supply between first media support member 24 and second media support member 25.

Figure 12:
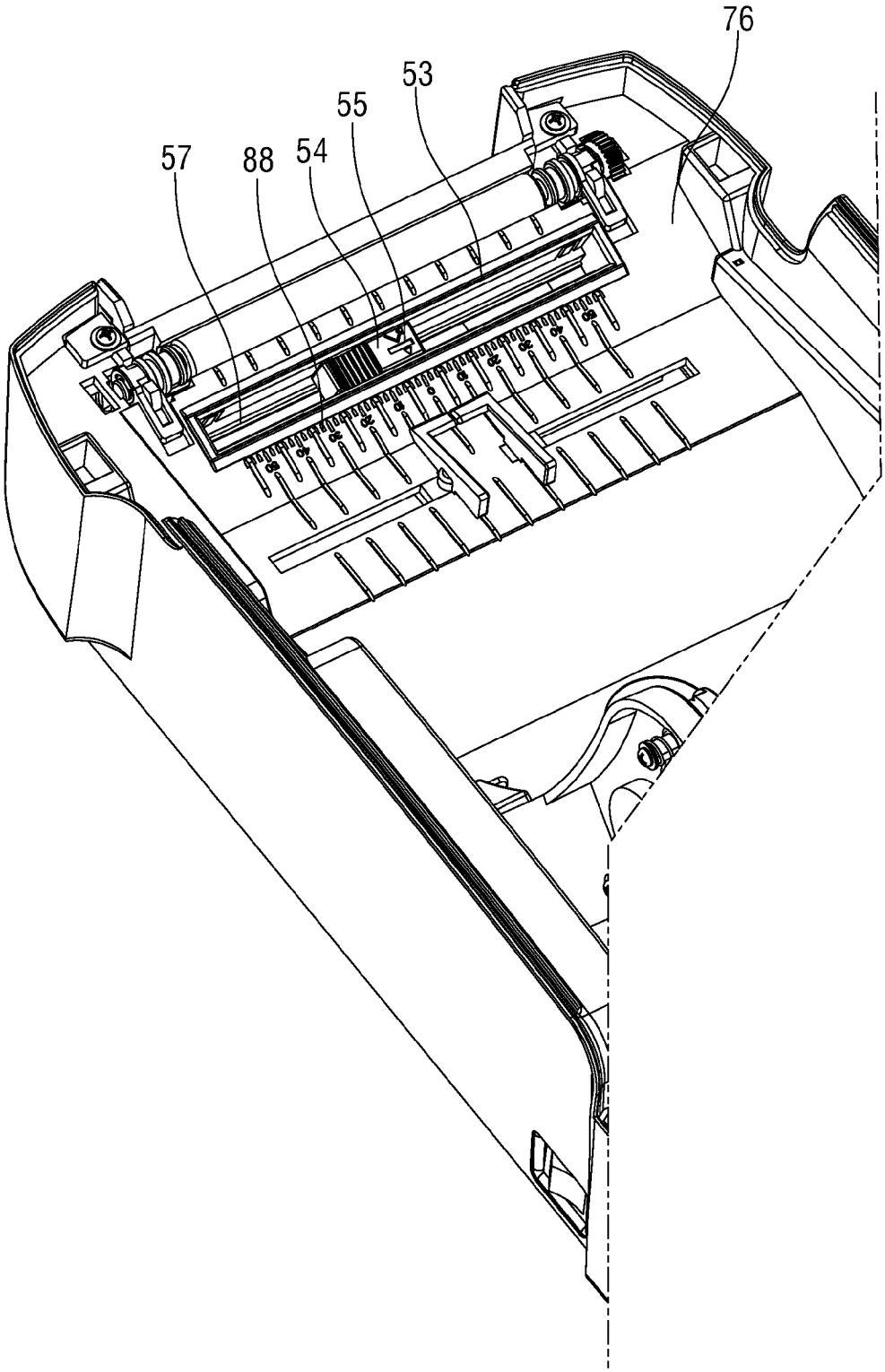
FIG. 12 is a detail view of an example embodiment of a media sensor assembly in accordance with the present disclosure.

Turning now to FIG. 12, printer 10 includes an adjustable media sensor assembly 53 transversely disposed in lower chassis 34 across a feed path 76. Adjustable media sensor assembly 53 includes an elongated cavity 57 having a media sensor 54 slidably disposed therein. Media sensor 54 is selectively positionable along cavity 57, which enables media sensor 54 to be aligned with index marks, media gaps, or other positional indicia characteristic of the print media, which, in turn, enables printer 10 to accurately feed and position media during use. Media sensor 54 includes an aperture 55 defined therein to enable a sensing element (not explicitly shown), such as without limitation a photodiode, to sense media indicia. In an alternative embodiment, printer 10 includes a fixed media sensor having an aperture defined therein to enable a sensing element (not explicitly shown), such as without limitation a photodiode, to sense media indicia therethrough. Media sensor 54 and/or fixed media sensor are aligned with and cooperate with an excitation element (not explicitly shown), e.g., a light emitting diode, disposed on print head 68 such that a light beam emitted from excitation element is detectable by media sensor 54 and/or fixed media sensor. Media sensor 54 and/or fixed media sensor may thus sense when the light beam is interrupted or reduced in intensity by a portion of media passing between media sensor 54 and/or fixed media sensor, and excitation element.

In a non-limiting example, a roll of self-adhesive label media includes a series of discrete labels disposed on a continuous length of backing material. A gap exists between successive labels where only the backing material is exposed. As the gap passes between the sensing element and the excitation element, the level of light transmitted from the excitation element to the sensing element varies, enabling the detection of the edges of individual media labels.

In embodiments, the position of the sensing element (not explicitly shown) and excitation element (not explicitly shown) may be swapped while keeping within the spirit and scope of the present disclosure. In an embodiment, the position of excitation element (not explicitly shown) is adjustable along a transverse axis of motion (e.g., across the width of print head 68) to coordinate the alignment of excitation element (not explicitly shown) with the position of media sensor 54. Graduations may be provided adjacent to excitation element (not explicitly shown) to facilitate the alignment of excitation element (not explicitly shown) via corresponding graduations 88 provided adjacent to media sensor 54.

Figure 13:
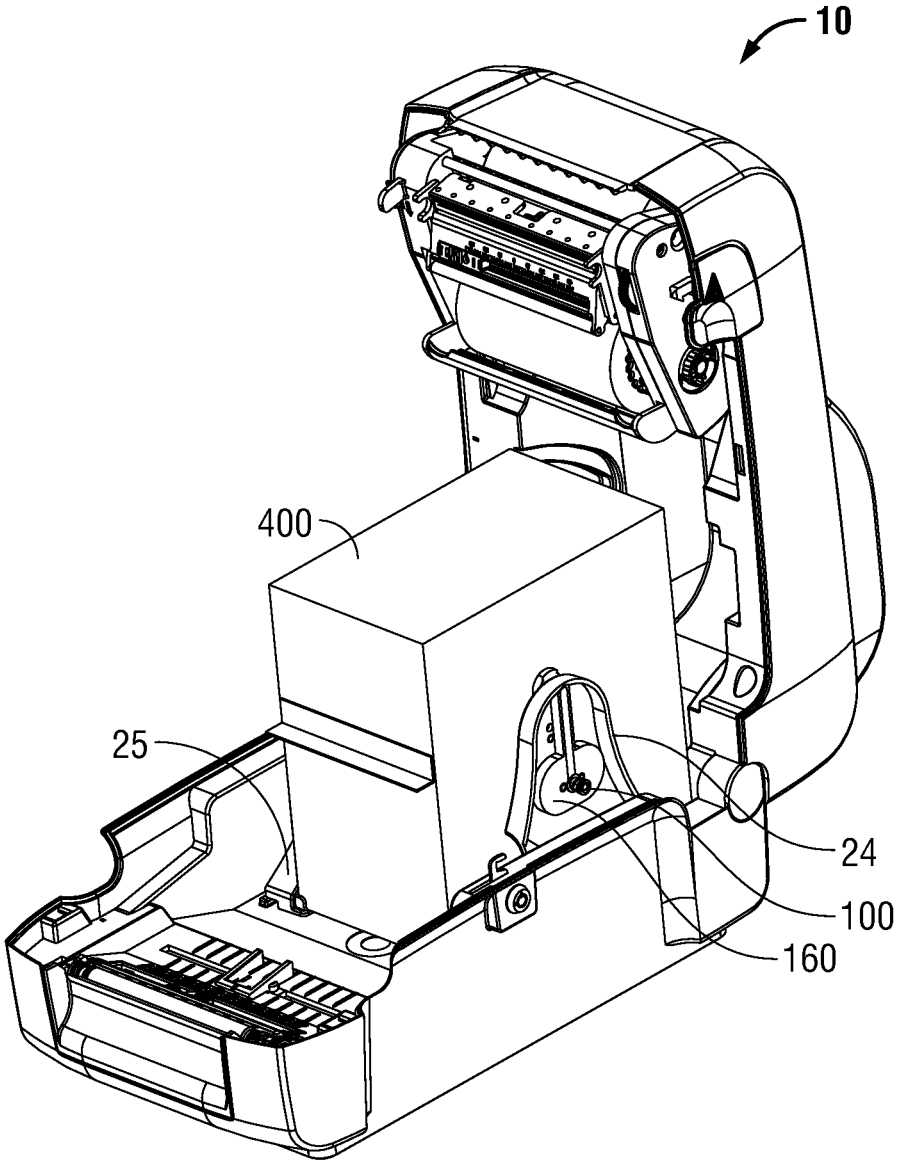
FIG. 13 is a view of a printer with a media cartridge installed in the printer in accordance with an embodiment of the present disclosure.

Turning now to FIG. 13, printer 10 is shown with media adjustment assembly 100 in a third position (FIG. 11C) with a fanfold media cartridge 400 installed. With media adjustment assemblies 100 in the third position, media adjustment members 110 are disposed within detent 160 such that media adjustment members 110 lay flush with inner surfaces 24*a* and 25*a* of media support members 24 and 25, respectively. In this arrangement, fanfold media cartridge 400 may be placed in between media support members 24 and 25 without any obstruction by media adjustment members 110.

Figure 14:
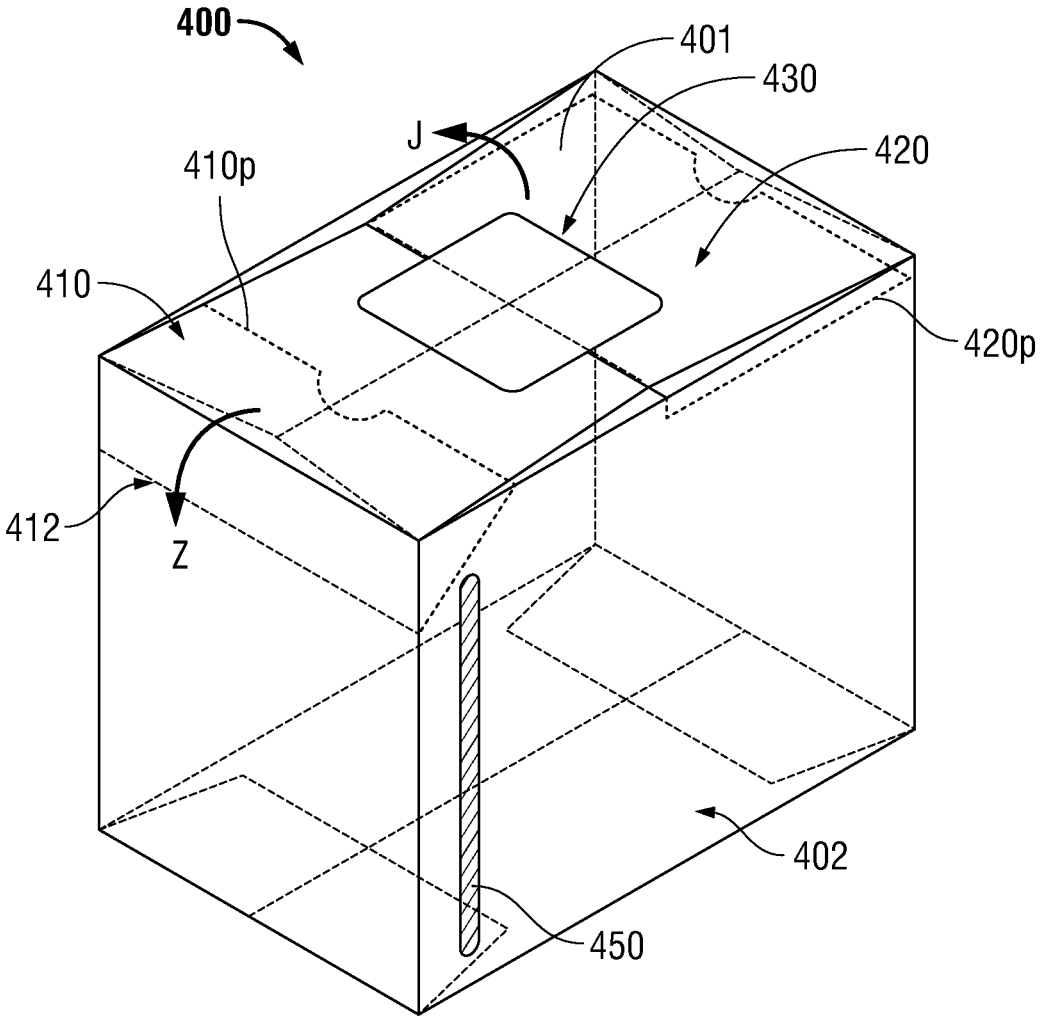
FIG. 14 is a view othe media cartridge of FIG. 13 in accordance with an embodiment of the present disclosure.

Turning now to FIG. 14, a media cartridge 400 is shown prior to being positioned in the printer 10 (FIG. 13). Media cartridge may include fold down ledge 410 and media relief top rear panel 420. Additionally, media cartridge may include label 430 which may include information pertaining to the particular media contained within cartridge, such as without limitation, the color, width, or length of the media. Top portion 401 of media cartridge 400 includes a perforated portion 410*p* which extends to side portions 402 of media cartridge 400. Similarly, rear portion (not shown) may include a perforated portion 420*p* which extends to side portions 402 of media cartridge 400. In use, perforated portion 410*p* may be released to pivot the fold down ledge 410 about a pivot user fold line 412 in the direction of arrow "Z" to form an opening. Media relief top rear panel 420 may be released along perforation portion 420*p* to pivot media relief top rear panel 420 in the direction of arrow "J" to form an opening. An internal supply of media may exit through the opening formed by either fold down ledge 410 or top rear panel 420.

Continuing with reference to FIG. 14, media cartridge 400 may also include media sensor channel 450 on either or both sides of media cartridge 400 for determining the level of media remaining in the media cartridge 400. Media sensor channel 450 includes an aperture defined therein to enable a sensing element (not explicitly shown), such as without limitation a photodiode, to sense the level of media remaining. Media sensor channel 450 is aligned with and cooperates with an excitation element (not explicitly shown), e.g., a light emitting diode, disposed internal to printer 10, and directly adjacent to media sensor channel 450, such that a light beam emitted from excitation element is detectable to determine the level of media remaining.

The described embodiments of the present disclosure are intended to be illustrative rather than restrictive, and are not intended to represent every embodiment of the present disclosure. Further variations of the above-disclosed embodiments and other features and functions, or alternatives thereof, may be made or desirably combined into many other different systems or applications without departing from the spirit or scope of the disclosure as set forth in the following claims both literally and in equivalents recognized in law.

What is claimed is:

1. A media support member, comprising:

a media adjustment channel disposed in the media support member;

a media adjustment member slidingly disposed through the media adjustment channel;

a recess continuous with the media adjustment channel and configured to receive the media adjustment member, such that the media adjustment member is flush with an inner surface of the media support member; and a resilient member configured to apply friction between the media adjustment member and the inner surface of the media support member.

2. The media support member as claimed in claim 1, wherein the media adjustment member further comprises at least one tab, and the media support member further comprises at least one tab receiving member, wherein the at least one tab is configured to engage with the at least one tab receiving member.

3. The media support member as claimed in claim 1, wherein the media adjustment member further comprises an engaging member on a first end of the media adjustment member and a shaft on a second end of the media adjustment member.

4. The media support member as claimed in claim 3, wherein the shaft is slidingly disposed in the media adjustment channel.

5. The media support member as claimed in claim 3, wherein the resilient member is a compression spring which substantially surrounds the shaft, and wherein the compression spring is secured by a retaining member which is threadedly engaged with the shaft.

6. A printer, comprising:

a bottom housing;

a top cover coupled to the bottom housing, the top cover being adapted to rotate away from the bottom housing to an open position and rotate toward the bottom housing to a closed position; and at least one media support member including:

a media adjustment channel disposed in the at least one media support member;

a media adjustment member slidingly disposed through the media adjustment channel;

a recess continuous with the media adjustment channel and configured to receive the media adjustment member, such that the media adjustment member is flush with an inner surface of the at least one media support member; and a resilient member configured to apply friction between the media adjustment member and the inner surface of the at least one media support member.

7. The printer as claimed in claim 6, further comprising:

a slot formed on the top cover and a protrusion disposed on the top cover; and a friction member disposed through the slot and a female pocket disposed on the friction member; wherein the protrusion is configured to rest within the female pocket.

8. The printer as claimed in claim 7, wherein selective engagement of the protrusion with the female pocket inhibits movement of the friction member.

9. The printer as claimed in claim 6, further comprising:

a print frame assembly coupled to the top cover, the print frame assembly being adapted to rotate out of the top cover to an open position and to rotate into the top cover to a closed position; and wherein the top cover is prevented from rotating toward the bottom housing to the closed position when the print frame assembly is in the open position.

10. The printer as claimed in claim 6, wherein the at least one media support member includes a first media support member and a second media support member reciprocally movable along a transverse axis of the printer and configured to support media therebetween.

11. The printer as claimed in claim 6, further comprising a stop selectively adjustable along a transverse axis of the printer and adapted to prevent transverse motion of the at least one media support member.

12. The printer as claimed in claim 6, wherein the media adjustment member further comprises at least one tab and at least one tab receiving member, wherein the at least one tab is configured to engage with the at least one tab receiving member.

13. The printer as claimed in claim 6, wherein the media adjustment member further comprises an engaging member on a first end of the media adjustment member and a shaft on a second end of the media adjustment member.

14. The printer as claimed in claim 13, wherein the shaft is slidingly disposed in the media adjustment channel.

15. The printer as claimed in claim 13, wherein the resilient member is a compression spring which substantially surrounds the shaft, and wherein the compression spring is secured by a retaining member which is threadedly engaged with the shaft.

16. A printer system, comprising:

a first media support member and a second media support member, wherein each of the first and second media support members includes:

a media adjustment channel disposed in the respective one of the first and second media support members;

a media adjustment member slidingly disposed through the respective media adjustment channel;

a recess continuous with the media adjustment channel and configured to receive the media adjustment member, such that the media adjustment member is flush with an inner surface of the respective one of the first and second media support members; and a resilient member configured to apply friction between the media adjustment member and the inner surface of the respective one of the first and second media support members.

17. The printer system as claimed in claim 16, further comprising a media cartridge disposed between the first media support member and the second media support member.

18. The system as claimed in claim 17, wherein the media cartridge further comprises a media sensor channel disposed on at least one side of the media cartridge.

* * * * *